US007017869B2

(12) United States Patent
Wang

(10) Patent No.: US 7,017,869 B2
(45) Date of Patent: Mar. 28, 2006

(54) TILTING SUPPORT DEVICE HAVING DAMPING DEVICE

(76) Inventor: King Sheng Wang, No. 191, Dong Si 9th Road, Si An Tsuen, Da An Hsiang, Taichung Hsien (TW), 439

( * ) Notice: Subject to any disclaimer, the term of this patent is extended or adjusted under 35 U.S.C. 154(b) by 21 days.

(21) Appl. No.: 09/812,853

(22) Filed: Mar. 21, 2001

(65) Prior Publication Data

US 2002/0134894 A1 Sep. 26, 2002

(51) Int. Cl.
*A63B 55/00* (2006.01)

(52) U.S. Cl. ..... 248/96; 248/188; 248/558; 248/97; 206/315.7

(58) Field of Classification Search ..... 248/96, 248/188, 558, 562, 584, 595, 97; 206/315.7, 206/315.8, 315.3; 211/70.2
See application file for complete search history.

(56) References Cited

U.S. PATENT DOCUMENTS 1,738,242 A * 12/1929 Gunther ..... 248/96
3,223,430 A * 12/1965 Fitzsimmons ..... 280/13
4,893,522 A * 1/1990 Arakawa ..... 74/574
5,096,148 A * 3/1992 Quellais et al. ..... 206/315.7
5,356,003 A * 10/1994 Gretz et al. ..... 206/315.7
5,407,155 A * 4/1995 Chung ..... 206/315.7
5,497,964 A * 3/1996 Hagiwara ..... 206/315.7
5,516,064 A * 5/1996 Hsieh ..... 248/688
5,597,144 A * 1/1997 Lee ..... 248/169
5,673,879 A * 10/1997 Hsieh ..... 206/315.7
5,743,575 A * 4/1998 McFarland ..... 292/336.3
5,816,544 A * 10/1998 Hsieh ..... 206/315.7
6,139,047 A * 10/2000 Kim ..... 280/47.26
6,312,049 B1 * 11/2001 Sullivan et al. ..... 297/216.1
6,397,436 B1 * 6/2002 Wang ..... 16/445
6,511,036 B1 * 1/2003 Hansen ..... 248/596

* cited by examiner

*Primary Examiner*—Kimberly Wood

(57) ABSTRACT

A tilting support device includes a base rotatably secured to the lower portion of the golf bag, one or more legs rotatably secured to the upper portion of the golf bag and rotatable between an open position and a folding position, and a spring member coupled between the base and the legs for resiliently moving the legs outward to the working position when the golf bag is rotated or tilted relative to the base. A damping device is disposed between the legs and the golf bag for damping a rotational movement between the legs and the golf bag.

8 Claims, 11 Drawing Sheets

TILTING SUPPORT DEVICE HAVING DAMPING DEVICE

BACKGROUND OF THE INVENTION

1. Field of the Invention

The present invention relates to a support devices and more particularly to a tilting support device for supporting an object in a suitable tilting position and having a damping device for damping the rotational movement of the supporting legs.

2. Description of the Prior Art

Typical objects, such as the golf bags are required to be supported in a tilting position while in use, with a support device. The support device includes one or more legs rotatably secured to the golf bag and foldable between an open working position and a folded storing position. The legs may be quickly rotated or folded to engage with the golf bag when the golf bag is erected to the upright position. The users hand may be clamped and hurt by the legs inadvertently when the legs of the support device are rotated toward the golf bag.

The present invention has arisen to mitigate and/or obviate the afore-described disadvantages of the conventional tilting support devices.

SUMMARY OF THE INVENTION

The primary objective of the present invention is to provide a tilting support device for supporting an object in a suitable tilting position and having a damping device for damping the rotational movement of the supporting legs and for preventing the users from being hurt by the support device inadvertently.

In accordance with one aspect of the invention, there is provided a tilting support device comprising an object, such as a golf bag, including an upper portion and a lower portion, a base including a first end rotatably secured to the lower portion of the golf bag and including a second end, two legs each including a first end rotatably secured to the upper portion of the golf bag and rotatable between an open working position and a folding position, and a spring member coupled between the second end of the base and the legs for resiliently moving the legs outward to the open working position when the golf bag is rotated relative to the base.

A tube is further provided and includes a first end rotatably secured to the second end of the base and includes a second end, the spring member includes a first end secured in the second end of the tube and includes a second end coupled to the legs.

The second end of the spring member includes two arms coupled to the legs respectively. Two couplers are secured on the first ends of the legs respectively and each includes an extension extended therefrom and off-set from the first end of the coupler, the arms of the spring member being engaged to the extensions respectively.

A damping device is further provided for damping a rotational movement between the legs and the golf bag.

The golf bag includes a shaft provided thereon, the leg includes a sleeve provided thereon and rotatably engaged on the shaft, the damping means includes a damping fluid received in the sleeve for damping a rotational movement of the sleeve relative to the shaft.

The golf bag includes a seat secured thereon and having the shaft extended from the seat, the leg includes a coupler secured thereon and having the sleeve provided thereon for rotatably engaged on the shaft of the seat.

The shaft includes a bore formed therein and includes an outer peripheral portion having at least one recess formed therein, and includes at least one aperture formed therein for communicating the bore with the recess of the shaft.

The damping means further includes a rod secured to the sleeve and engaged in the shaft. The rod includes an outer peripheral portion having at least one cavity formed therein.

The sleeve includes a stop provided therein, the rod includes a depression formed therein for receiving the stop and for preventing the rod from rotating relative to the sleeve.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
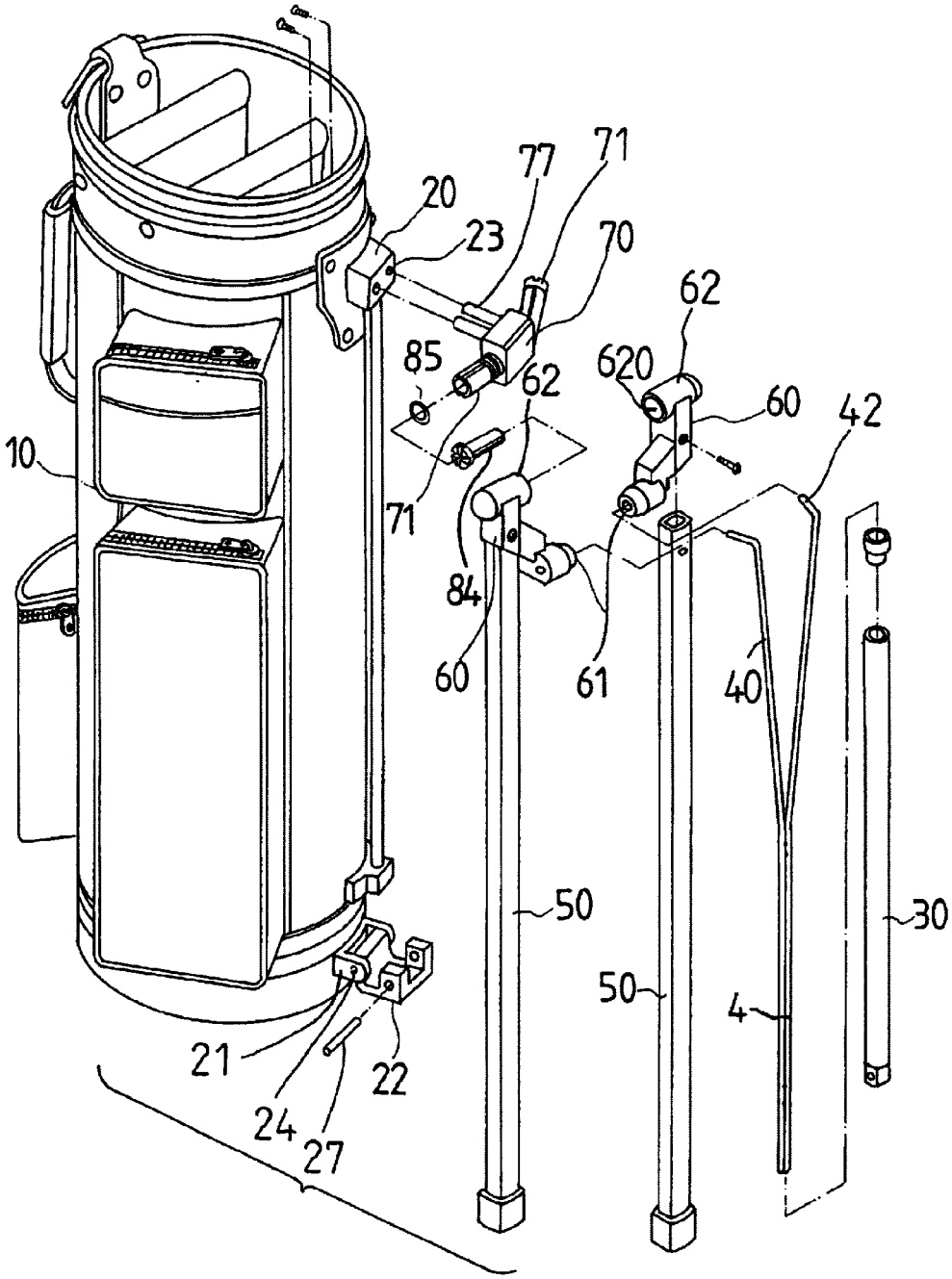
FIG. 1 is a partial exploded view of a tilting support device in accordance with the present invention, for supporting such as a golf bag.
Figure 2:
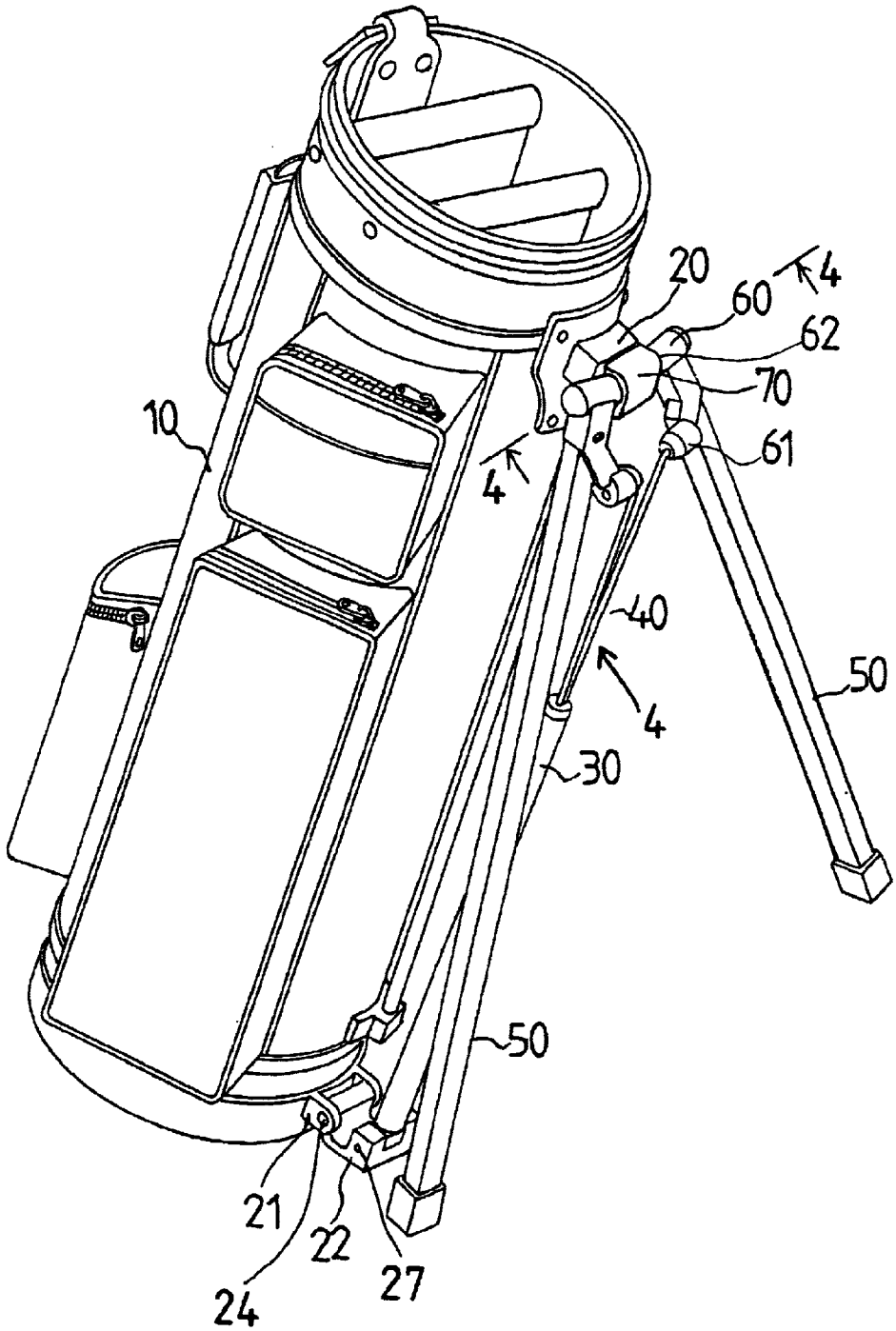
FIG. 2 is a perspective view of the tilting support device for the object.

Referring to the drawings, and initially to FIGS. 1–5, a tilting support device in accordance with the present invention is provided for selectively supporting an object 10, such as a golf bag 10, in a tilting position. The object 10 comprises a block 20 secured to the upper portion thereof and having one or more holes 23 formed therein; and a bracket 21 provided or secured on the lower portion thereof. A base 22 is rotatably or pivotally secured to the bracket 21 with a pivot pin 24. A tube 30 has a lower end rotatably or pivotally secured to the base 22 with a pivot axle 27. A seat 70 includes one or more fasteners or projections or pins 77 extended therefrom for engaging into the holes 23 of the block 20 and for securing to the upper portion of the object 10, by such as a force-fitted engagement, or by the fasteners, or by the welding processes. The seat 70 includes one or more, such as two shafts 71 extended outward therefrom.

One or more, such as two couplers 60 are secured on top of one or more, such as two legs 50 respectively, with such as the fasteners, and each includes a sleeve 62 provided on top thereof and having an orifice 620 formed therein for rotatably receiving the shafts 71 respectively, and for rotatably securing the legs 50 to the object or the golf bag 10. The couplers 60 each includes an extension 61 extended therefrom and off-set from the sleeve 62. A spring member 4 includes a lower portion engaged in and secured to the tube 30 and includes two arms 40 provided on top thereof and secured to the extensions 61 of the couplers 60 respectively with a hook end 42, for example.

Figure 5:
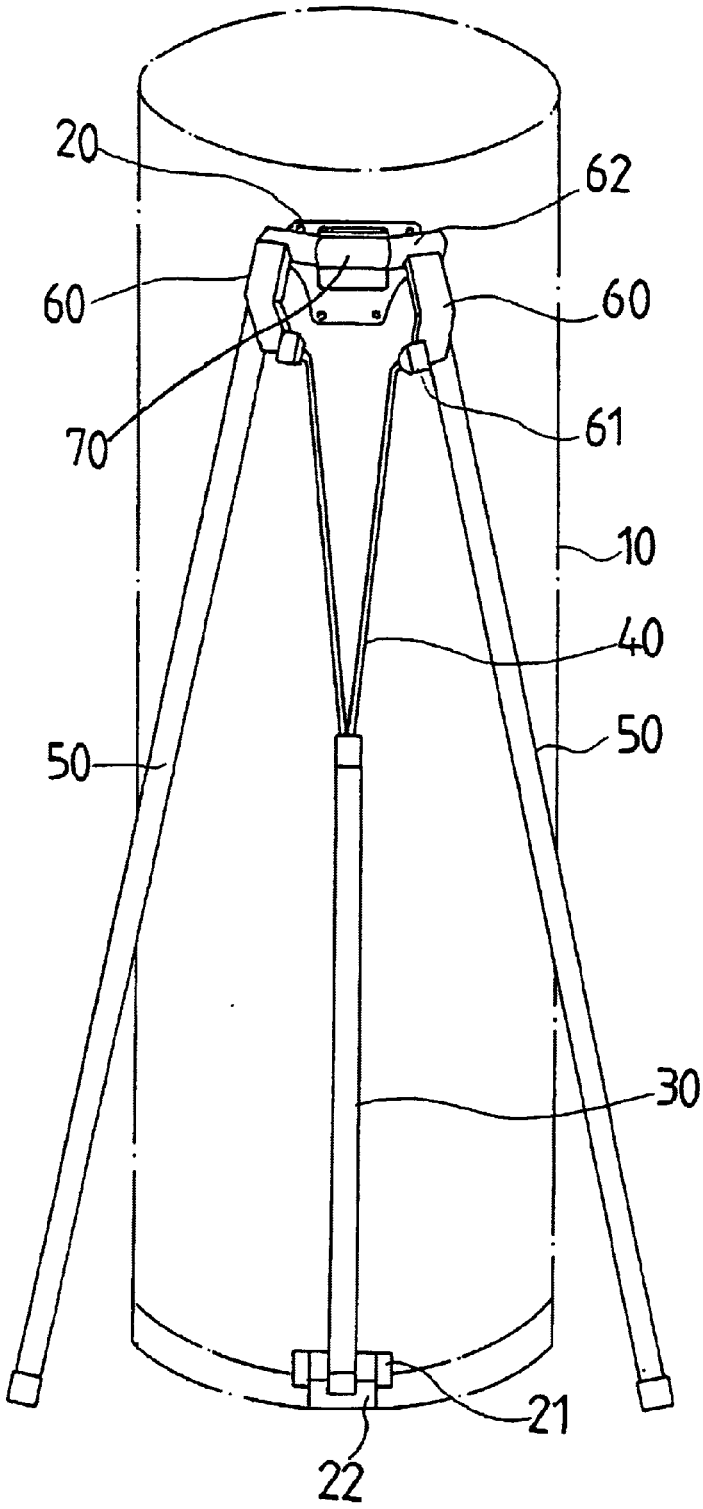
FIG. 5 is a partial plane view showing the operation of the tilting support device for the object.
Figure 6:
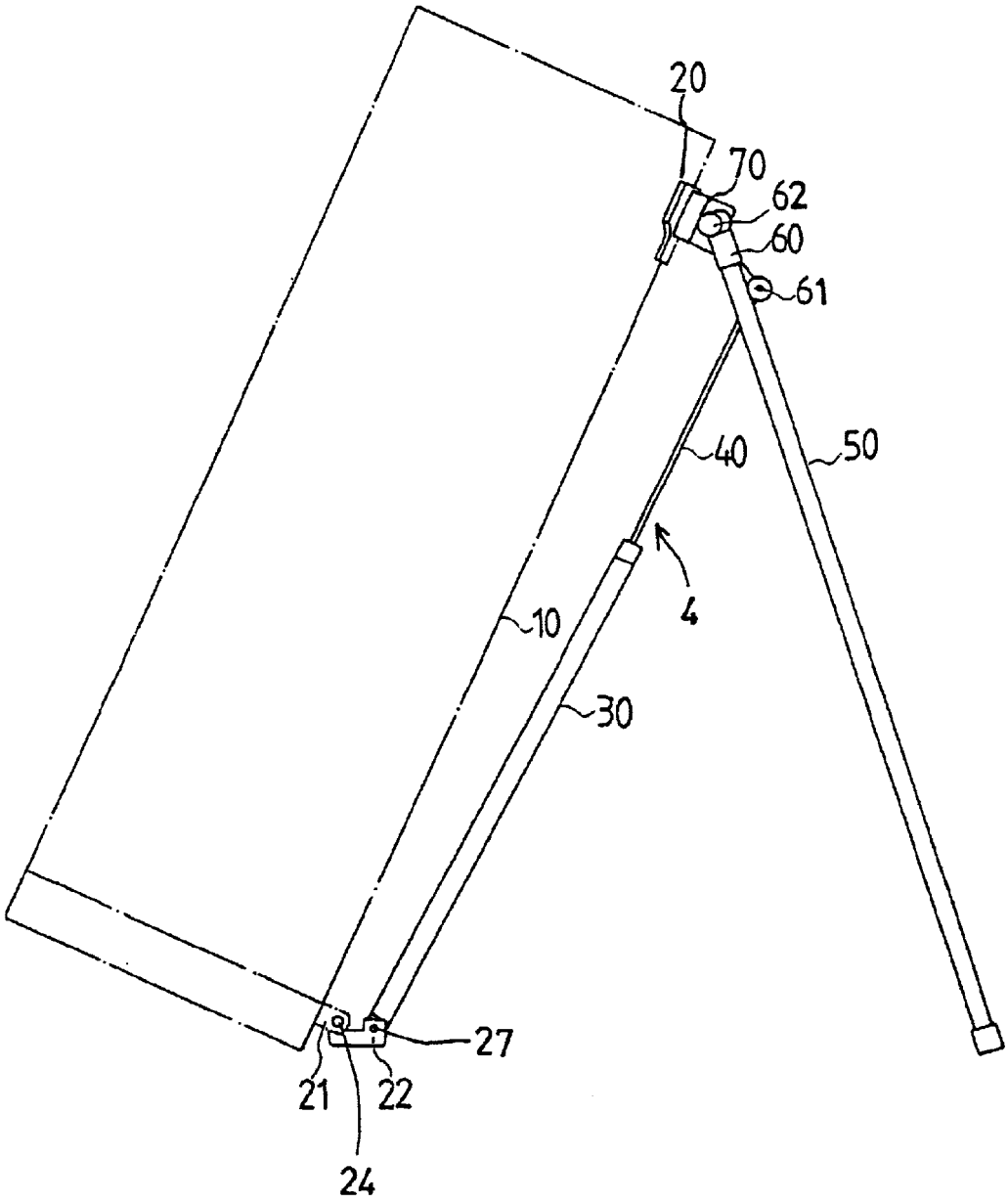
FIG. 6 is a partial side view showing the operation of the tilting support device for the object.
Figure 7:
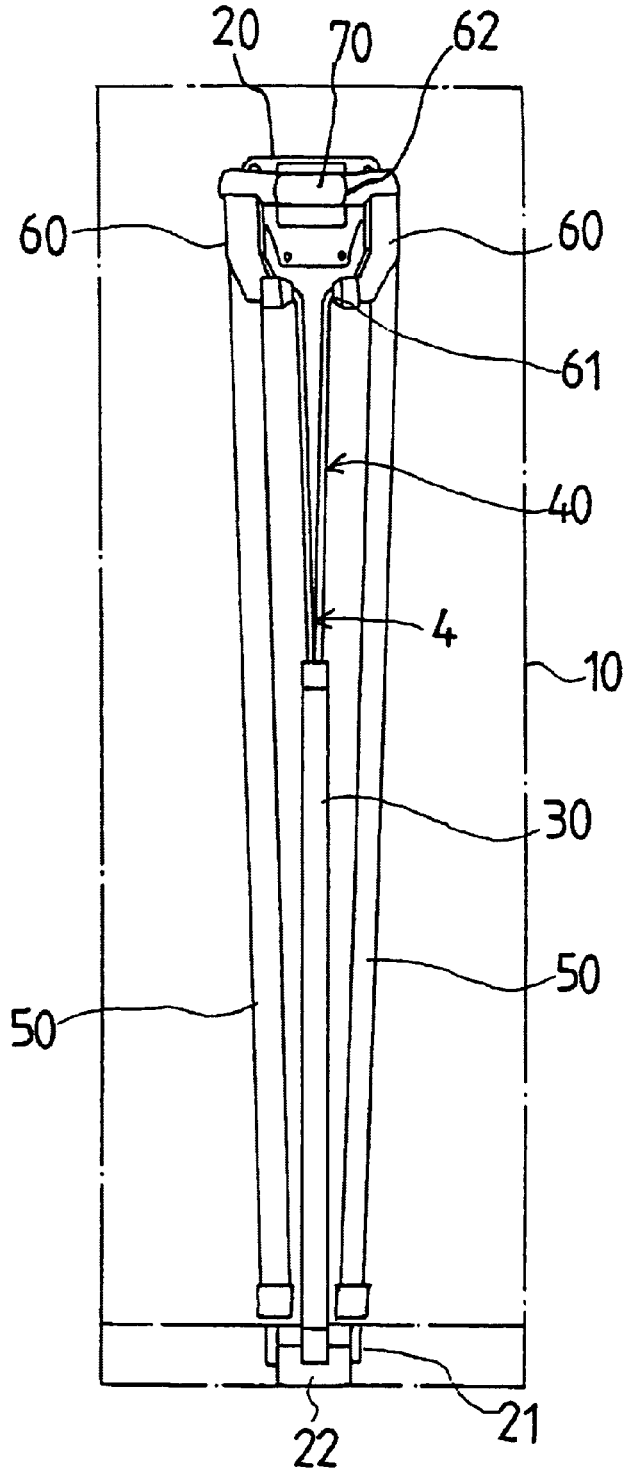
FIGS. 7 and 8 are partial plane view and partial side view similar to FIGS. 5 and 6 respectively, for showing the operation of the tilting support device for the object.
Figure 8:
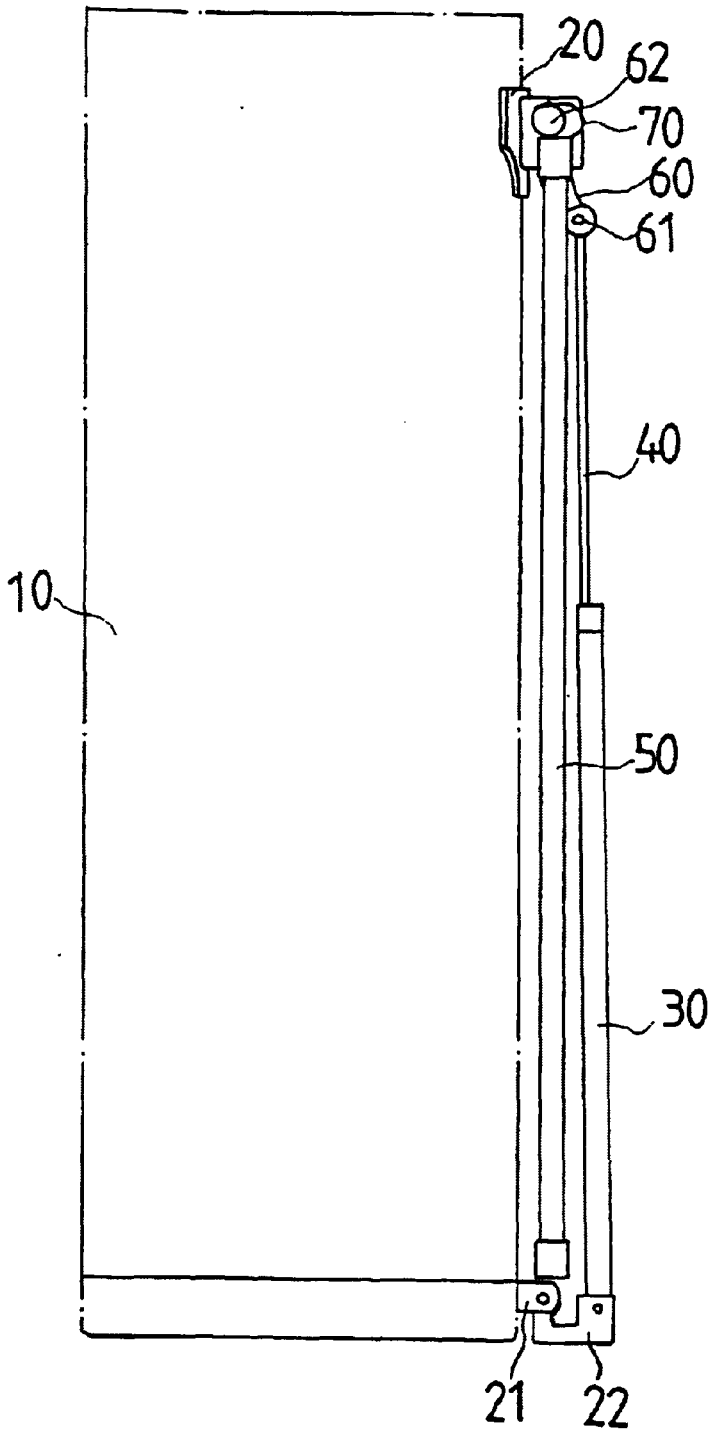

In operation, as shown in FIGS. 5 and 6, when the object or the golf bag 10 is tilted, the base 22 may be engaged with the supporting ground, and the golf bag 10 may be rotated relative to the base 22 about the pivot pin 24. The tube 30 and the arms 40 of the spring member 4 may apply a spring or resilient force against the couplers 60, such that the legs 50 may be rotated away from or outward of the golf bag 10 by the rotational engagement of the sleeves 62 on the shafts 71 respectively. As shown in FIGS. 7 and 8, when the golf bag 10 is rotated relative to the base 22 to an upright or erect position, the golf bag 10 may also be rotated relative to the base 22 about the pivot pin 24, and the tube 30 and the arms 40 of the spring member 4 may rotate the legs 50 backward or toward the golf bag 10 to the folding or storing position.

Figure 3:
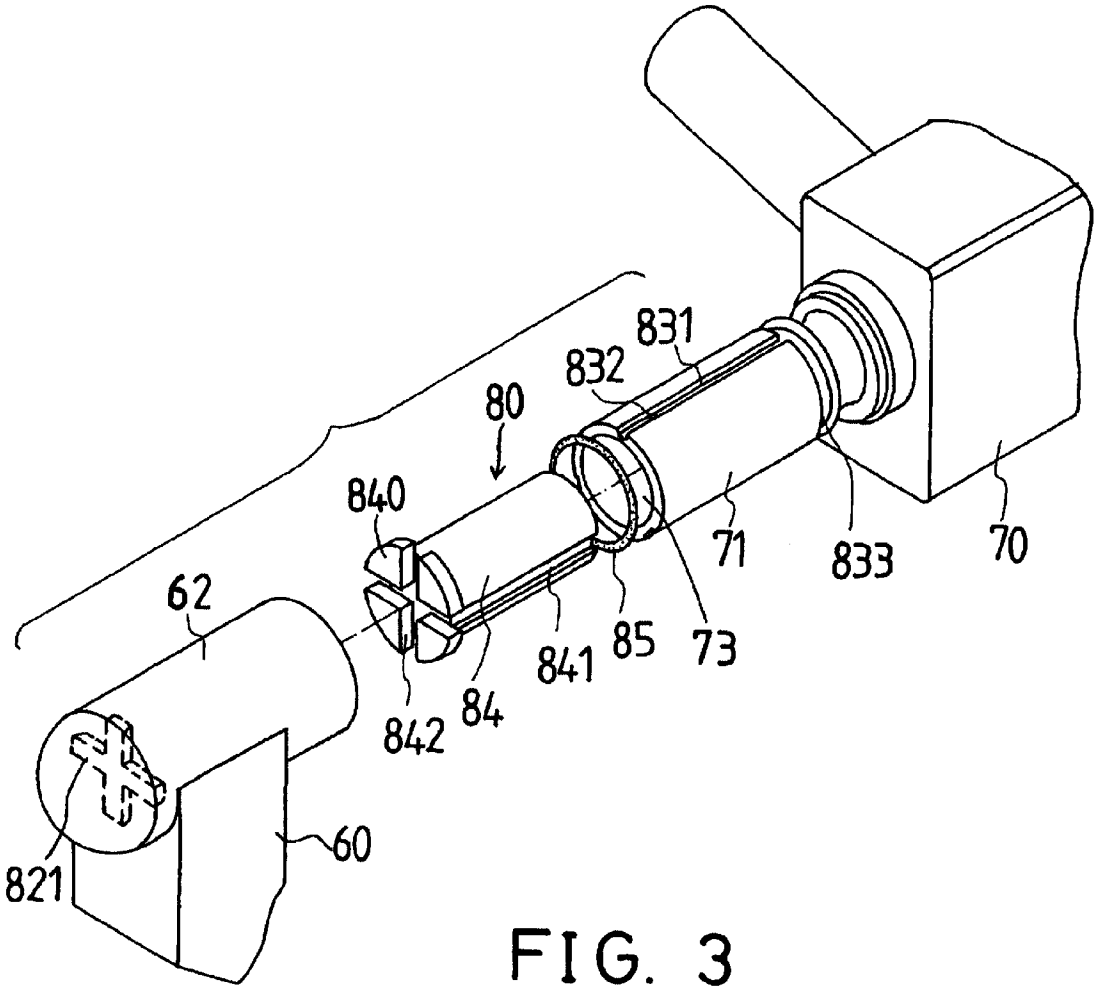
FIG. 3 is a partial exploded view showing the damping device for the tilting support device.
Figure 4:
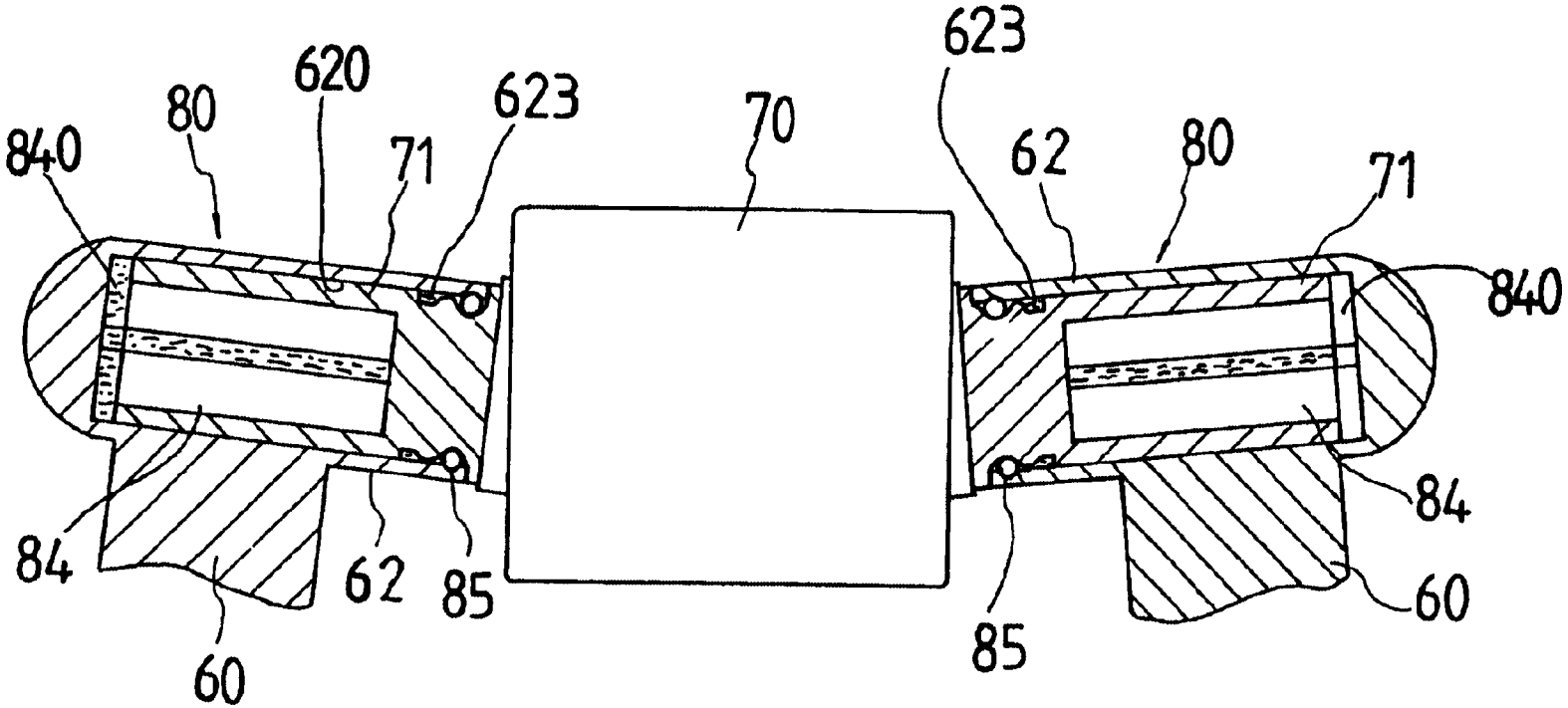
FIG. 4 is a partial cross sectional view taken along lines 4—4 of FIG. 2.

As shown in FIGS. 3 and 4, the tilting support device in accordance with the present invention further includes a damping device 80 for damping the rotational movement between the sleeves 62 and the shafts 71 respectively. The sleeves 62 each includes a stop, such as a cross-shaped stop 821 formed therein and extended inward of the orifice 620 of the sleeve 62. The shafts 71 each includes a bore 73 formed therein for receiving a fluid, such as the damping fluid 623 or the water or the oil therein, and each includes one or more apertures 832 formed therein for communicating the longitudinal recesses 831 of the shaft 71 with the bore 73 of the shaft 71, and each includes an annular groove 833 formed therein and located close to the seat 70. The shafts 71 each includes a sealing ring 85 engaged in the annular groove 833 thereof and engaged with the respective sleeve 62 for making a water tight seal between the sleeve 62 and the shaft 71.

The damping device 80 each includes a rod 84 engaged in the bore 73 of the shaft 71 and each includes an enlarged head 840 formed on one end of the rod 84 and each includes a depression 842, such as a cross-shaped depression 842 formed in the head 840 of the rod 84 for receiving the stop 821 and for preventing the rod 84 from rotating relative to the sleeve 62. The head 840 of the rod 84 is engaged between the sleeve 62 and the shaft 71. The rods 84 each includes one or more cavities, such as one or more longitudinal cavities 841 formed in the outer peripheral portion thereof for receiving the damping fluid 623. The damping fluid 623 may flow between the cavities 841 of the rod 84 and the recesses 831 of the shat 71 via the apertures 832 of the shaft 71, for damping the rotational movement of the sleeve 62 relative to the shaft 71.

Figure 9:
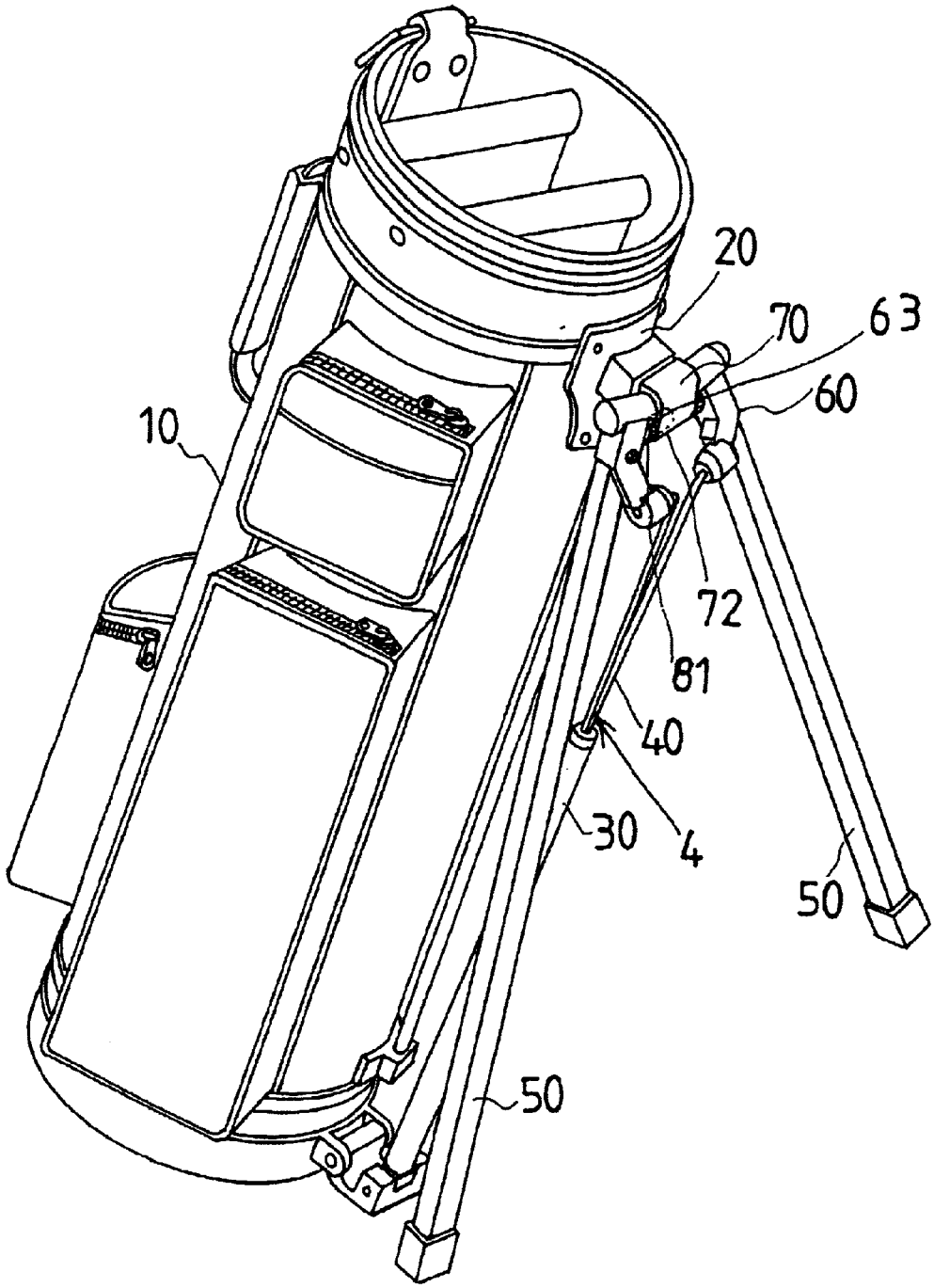
FIG. 9 is a perspective view showing the other embodiment of the tilting support device for the object.
Figure 10:
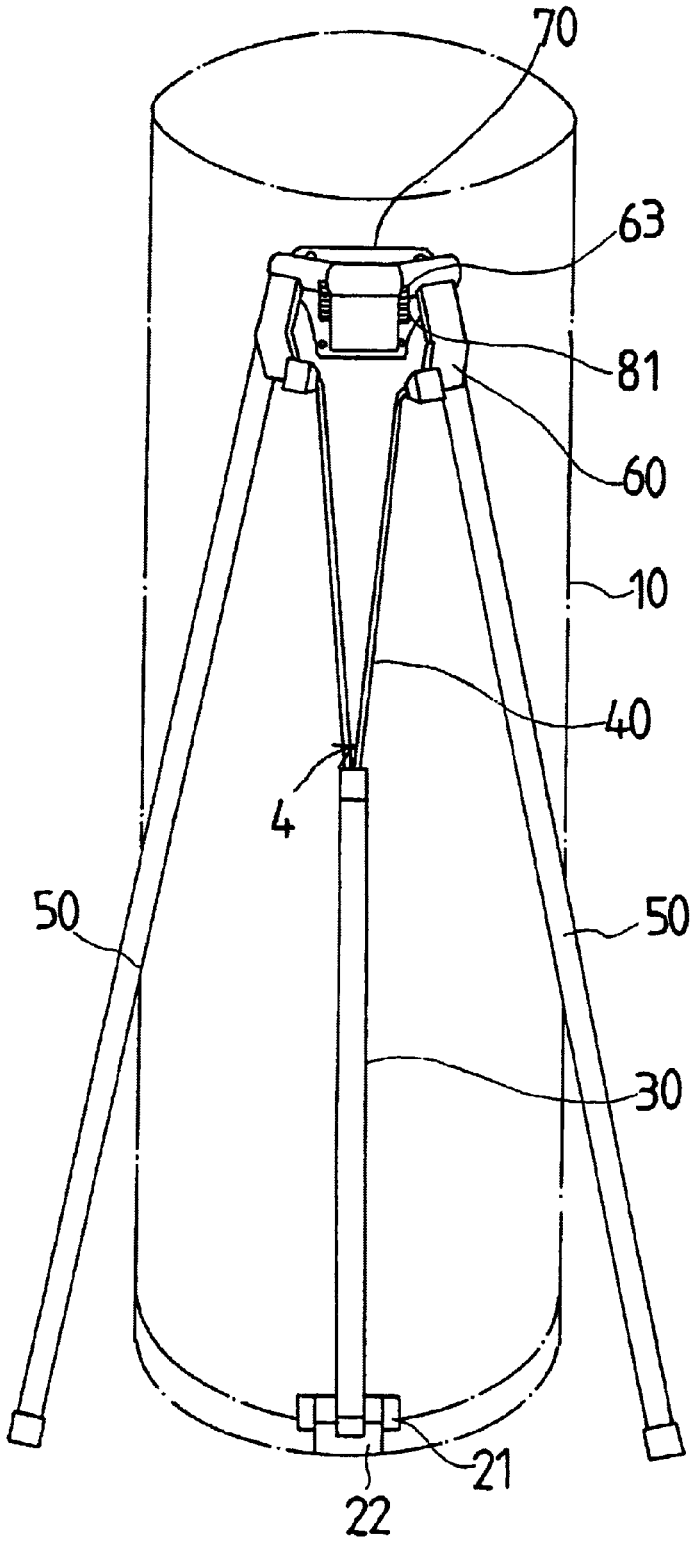
FIG. 10 is a partial plane view showing the operation of the tilting support device as shown in FIG. 9.
Figure 11:
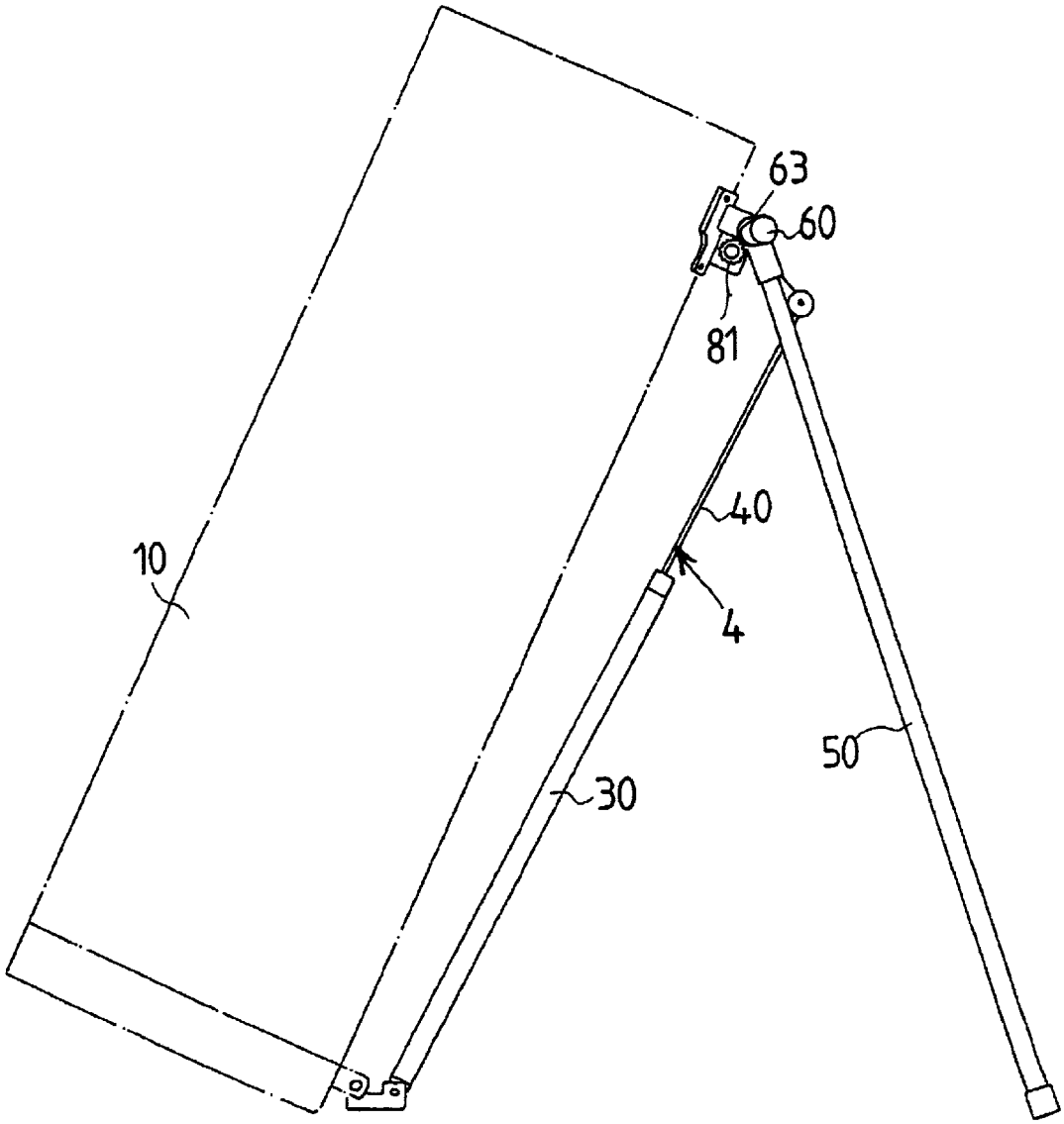
FIG. 11 is a partial side view showing the operation of the tilting support device as shown in FIGS. 9 and 10.

Referring next to FIGS. 9–11, illustrated is another embodiment of the damping device for the tilting support device. The damping device includes two pinions 81 rotatably secured to the seat 70, and includes two sectors or gears 63 formed on the sleeves 62 respectively and engaged with the pinions 81 for damping the rotational movement of the sleeve 62 relative to the shaft 71 when the sleeve 62 is rotated relative to the shaft 71 and when the legs 50 are rotated relative to the object or the golf bag.

Accordingly, the tilting support device in accordance with the present invention may be used for supporting an object in a suitable tilting position and having a damping device for damping the rotational movement of the supporting legs and for preventing the users from being hurt by the support device inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting supporting device comprising:

an object including a seat secured thereon, and including a shaft extended from said seat, at least one leg including a first end rotatably secured to said upper portion of said object and rotatable between an open working position and a folding position, and said at least one leg including a coupler secured thereon, and including a sleeve provided on said coupler and rotatably engaged on said shaft of said seat, and means for damping a rotational movement between said at least one leg and said object, said damping means including a damping fluid received in said sleeve for damping a rotational movement of said sleeve relative to said shaft.

2. A tilting support device comprising:

an object including a shaft provided thereon, said shaft including a bore formed therein and including an outer peripheral portion having at least one recess formed therein, and including at least one aperture formed therein for communicating said bore with said at least one recess of said shaft, at least one leg including a first end rotatably secured to said upper portion of said object and rotatable between an open working position and a folding position, and said at least one leg including a sleeve provided thereon and rotatably engaged on said shaft, and means for damping a rotational movement between said at least one leg and said object, said damping means including a damping fluid received in said sleeve for damping a rotational movement of said sleeve relative to said shaft.

3. The tilting support device according to claim 2, wherein said damping means further includes a rod secured to said sleeve and engaged in said shaft.

4. A tilting support device comprising:

an object including a shaft provided thereon, at least one leg including a first end rotatably secured to said upper portion of said object and rotatable between an open working position and a folding position, and said at least one leg including a sleeve provided thereon and rotatably engaged on said shaft, and means for damping a rotational movement between said at least one leg and said object, said damping means including a damping fluid received in said sleeve for damping a rotational movement of said sleeve relative to said shaft, and including a rod secured to said sleeve and engaged in said shaft, and said rod including an outer peripheral portion having at least one cavity formed therein.

5. A tilting support device comprising:

an object including a shaft provided thereon, at least one leg including a first end rotatably secured to said upper portion of said object and rotatable between an open working position and a folding position, said at least one leg including a sleeve provided thereon and rotatably engaged on said shaft, said sleeve including a stop provided therein, and means for damping a rotational movement between said at least one leg and said object, said damping means including a damping fluid received in said sleeve for damping a rotational movement of said sleeve relative to said shaft, and including a rod secured to said sleeve and engaged in said shaft, and said rod including a depression formed therein for receiving said stop and for preventing said rod from rotating relative to said sleeve.

6. A tilting support device comprising:

an object including a shaft provided thereon, said object including a lower portion, at least one leg including a first end rotatably secured to said upper portion of said object and rotatable between an open working position and a folding position, and said at least one leg including a sleeve provided thereon and rotatably engaged on said shaft, a base having a first end rotatably secured to said lower portion of said object and having a second end, a spring member coupled between said second end of said base and said at least one leg for resiliently moving said at least one leg outward to said open working position when said object is rotated relative to said base, and means for damping a rotational movement between said at least one leg and said object, said damping means including a damping fluid received in said sleeve for damping a rotational movement of said sleeve relative to said shaft.

7. The tilting support device according to claim 6 further comprising a tube including a first end rotatably secured to said second end of said base and including a second end, said spring member including a first end secured in said second end of said tube and including a second end coupled to said at least one leg.

8. The tilting support device according to claim 7 further comprising a coupler secured on said first end of said at least one leg and including an extension extended therefrom and off-set from said first end of said coupler, said second end of said spring member being engaged to said extension.

* * * * *